US006925721B2

(12) United States Patent
Dietz

(10) Patent No.: US 6,925,721 B2
(45) Date of Patent: Aug. 9, 2005

(54) ARCHERY BOW SIGHT

(76) Inventor: Paul T. Dietz, 8406 169th Ct. W., Lakeville, MN (US) 55044

( * ) Notice: Subject to any disclaimer, the term of this patent is extended or adjusted under 35 U.S.C. 154(b) by 0 days.

(21) Appl. No.: 10/656,703

(22) Filed: Sep. 6, 2003

(65) Prior Publication Data

US 2004/0079350 A1 Apr. 29, 2004

Related U.S. Application Data

(60) Provisional application No. 60/408,835, filed on Sep. 6, 2002.

(51) Int. Cl.[7] ..... F41G 1/467
(52) U.S. Cl. ..... 33/265; 124/87
(58) Field of Search ..... 33/265; 124/87

(56) References Cited

U.S. PATENT DOCUMENTS 4,020,560 A 5/1977 Heck
4,543,728 A 10/1985 Kowalski
5,414,936 A * 5/1995 Sappington ..... 33/265
5,507,272 A * 4/1996 Scantlen ..... 124/87
5,657,740 A 8/1997 Slates et al.
5,720,270 A 2/1998 Meicke
5,722,175 A * 3/1998 Slates ..... 33/265
6,026,799 A * 2/2000 Wiseby et al. ..... 124/87
6,401,347 B1 * 6/2002 Slates ..... 33/265
6,430,822 B1 8/2002 Slates
6,477,778 B1 * 11/2002 Lorocco ..... 33/265
6,477,779 B1 * 11/2002 Slates ..... 33/265
6,609,306 B2 * 8/2003 Johnson et al. ..... 33/265
6,688,008 B1 * 2/2004 Wuthrich ..... 33/265
6,701,632 B2 * 3/2004 Henry ..... 33/265

* cited by examiner

*Primary Examiner*—Christopher W. Fulton
*Assistant Examiner*—Tania Courson

(57) ABSTRACT

A bow sight that facilitates the accurate alignment of an arrow with respect to a target is described. The bow sight of the present invention includes an adjustment member that adjusts an aiming point in controlled, finite, repeatable, increments in both the horizontal and vertical plane relative to a fixed point on the bow. The adjustment member is separable from the frame of the bow sight without affecting the position of the aiming point on the bow sight.

12 Claims, 6 Drawing Sheets

ARCHERY BOW SIGHT

This application claims the benefit under 35 U.S.C. §120 of the filing date of U.S. provisional Patent Application Ser. No. 60/408,835, filed on Sep. 6, 2002.

FIELD OF THE INVENTION

This invention relates generally to devices used to facilitate the accurate alignment of an arrow with respect to a target, and more particularly relates to a bow sight that allows for adjustment of an aiming point on the sight. The bow sight of the present invention includes an adjustment member that may be utilized to adjust the aiming point in controlled, finite, repeatable, increments in both the horizontal and vertical plane relative to a fixed point on the bow. The adjustment member is separable from the frame of the bow sight without affecting the position of the aiming point on the bow sight, thereby reducing the weight of the bow sight, and providing for increased rigidity in the bow sight.

BACKGROUND OF THE INVENTION

Over the years, various bow sights have been constructed to assist an archer while aiming an arrow at a target. The bow sight may typically include a mounting member, frame, and aiming point. The mounting member attaches the frame to the bow and may include an extension positioned between the bow and sight frame. The aiming point is attached to the frame and may comprise a cylindrical housing, rectangular housing, slide plate, or other member that supports one or more sight pins, cross hairs, lens, or other reference point to align with a center point on a target. As an archer becomes more proficient at holding the bow at full draw, aligning the aiming point with the target, and releasing the bow string, the accuracy of the archer increases. As the archer's proficiency and accuracy increases, there is a desire to adjust in finite controlled increments the aiming point both vertically and horizontally to align the archer's eye and aiming point with the center of the target. Several sights have been developed in an attempt to allow for adjustment of the aiming point in the horizontal and vertical directions.

For example, Meicke in U.S. Pat. No. 5,720,270 describes a means for adjusting the sight pin of a bow. However, the bow sight shown and described by Meicke does not provide for adjustment of the sight pin in a controlled, finite, repeatable, increment in both the horizontal and vertical plane relative to a fixed point on the bow. Other attempts have been made to provide for finite adjustment of the sight pin in the horizontal and vertical direction. For example, U.S. Pat. Nos. 5,657,740, 6,430,822B1, 4,543,728, and 4,020,560 each describe a bow sight having one or more threaded pins mounted within one or more brackets that slide back and forth and adjoin sight pins to the bracket in various fashions. The brackets and multiple joints of the bow sights described in the '740, 822' '728, and 560 patents decrease the rigidity and increase the complexity of the bow sight and do not necessarily allow for finite, controlled, repeatable adjustment of the sight.

Thus, there is a need for a bow sight that is simple, rigid, and durable, but also allows for finite adjustment of the aiming point. The present invention meets these and other needs that will become apparent from a review of the description of the present invention.

SUMMARY OF THE INVENTION

The purpose of the present invention is to provide a bow sight that allows for adjustment of an aiming sight in controlled, finite, repeatable, increments in both the horizontal and vertical direction relative to a fixed point on a bow.

In one embodiment of the present invention, the bow sight includes a horizontal bar, a vertical slide, a vertical slide mount, and a removable adjustment member. The horizontal bar is adapted for receiving an aiming sight. The vertical slide slidably engages with the horizontal bar to allow movement of the horizontal bar in a horizontal direction. The vertical slide mount slidably engages with the vertical slide to allow movement of the vertical slide in a vertical direction.

Further, the removable adjustment member may be utilized to adjust the aiming sight in controlled, finite, repeatable, increments in both the horizontal and vertical direction relative to a fixed point on a bow. Pins extending from the first and second alignment members engage with corresponding holes in either horizontal bar and vertical slide or the vertical slide and the vertical mount. A threaded shaft is fixedly attached at one end to a knob, extends through a threaded hole of the second alignment member and is rotatably attached at the opposite end to the first alignment member. When the knob is rotated in either clockwise or counterclockwise the second alignment member moves linearly by a corresponding proportionate amount. Once the horizontal bar or vertical slide is adjusted by the desired finite increment, then the adjustment member is removed and the corresponding set screw is tightened. If the archer again desires to adjust the horizontal bar or vertical slide the pins are engaged with the corresponding holes and may be adjusted in a controlled repeatable amount.

Those skilled in the art will appreciate that the horizontal bar, vertical slide and vertical slide mount may be constructed in various sizes, altered shapes and altered configurations while still providing slidable engagement to the adjoining members. For example, without limitation, the vertical slide mount includes a slot in which the vertical slide engages, however the vertical slide and vertical slide mount could be altered so that the vertical slide, slidably engages to the outside of the vertical slide mount instead. Further, the shapes, sizes and configuration should be chosen to allow for the desired amount of rigidity and/or simplicity.

In an alternative embodiment the vertical slide mount is mounted to an extension, which in turn engages with a mounting member that is attached to the bow. Also, to dampen vibration affects of the bow when the string is released, a harmonic dampener of known suitable construction could be engaged to or adapted to fit into the mounting member, extension, vertical slide mount, vertical slide, or horizontal bar.

These and other advantages of the present invention will become readily apparent to those skilled in the art from a review of the description of the preferred embodiment and/or when considered in conjunction with the claims and accompanying drawings in which like numerals in the several views refer to corresponding parts.

DETAILED DESCRIPTION

Figure 1:
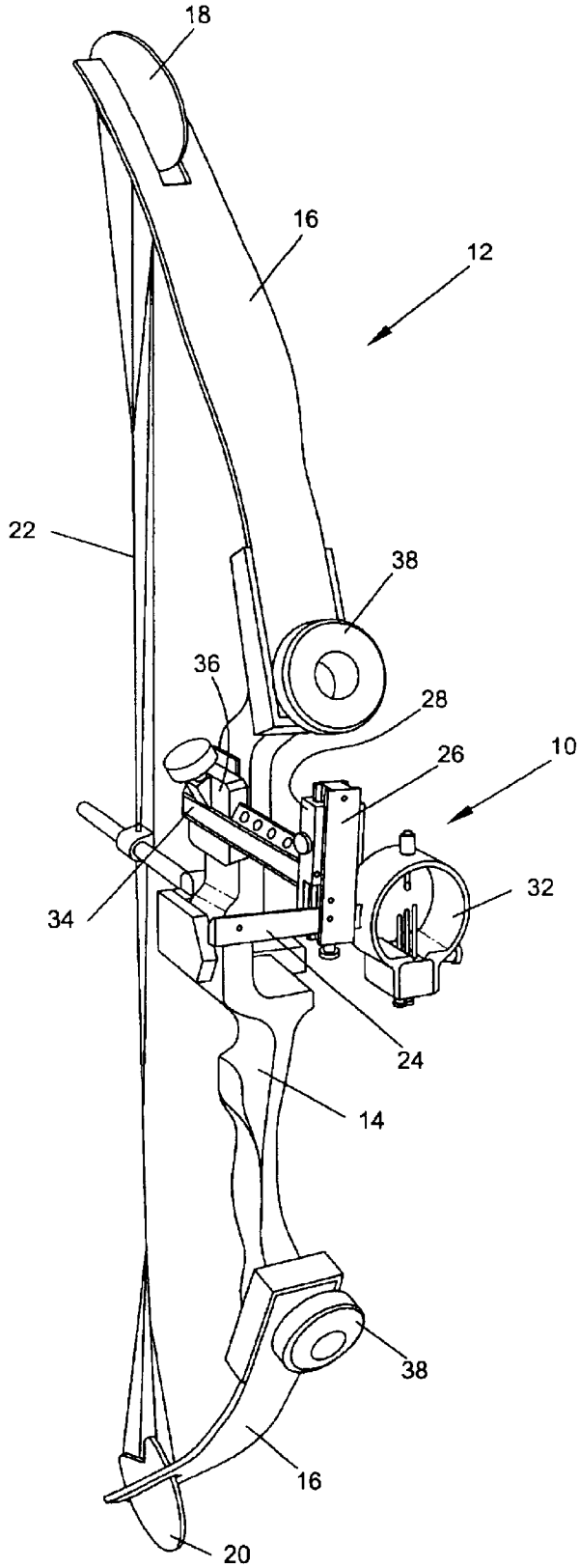
FIG. 1 is a front perspective view of one embodiment of the bow sight of the present invention engaged to an extension member and mounted to an archers bow.

Those skilled in the art will appreciate that the embodiments of the present invention described herein are exemplary and modifications may be made without departing from the intended scope of the invention. Referring first to FIG. 1 there is shown generally the bow sight 10 of the present invention mounted to a bow 12. The bow 12 includes a riser 14 and bow limbs 16 with the proximal ends of the limbs 16 mounted to the riser. Cams 18 and 20 are mounted to the distal end of bow limbs 16 and cables and bowstring 22 wrap around the cams 18 and 20. The bow sight 10 of the embodiment shown in FIG. 1, generally includes a horizontal bar 24, a vertical slide 26, a vertical slide mount 28, an aiming sight or scope 32, an extension member 34, and mounting member 36. Harmonic dampeners 38 are mounted to the proximal ends of the limbs 16 to reduce vibration in the limbs 16 and riser 14 when a fully drawn bowstring is released.

Figure 2:
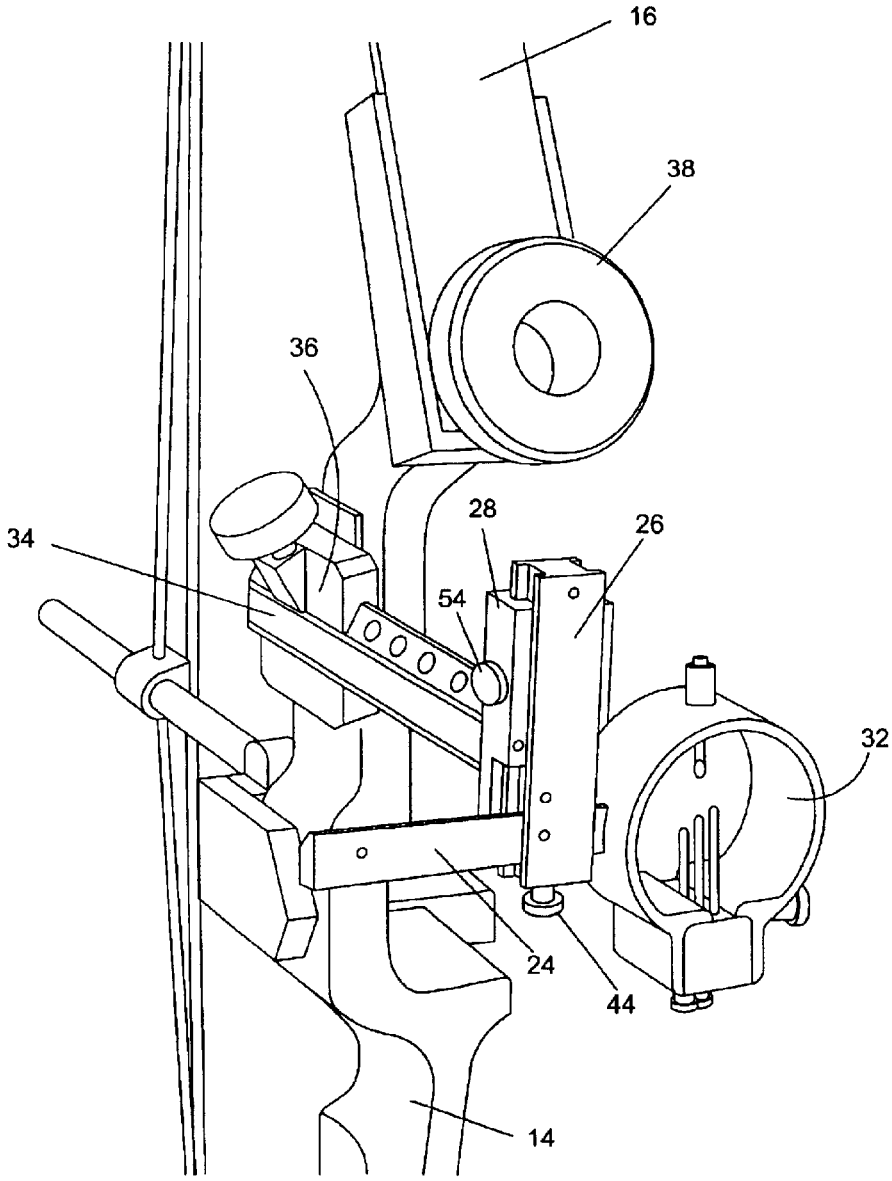
FIG. 2 is an enlarged partial front perspective view of the bow sight of the type shown in FIG. 1.
Figure 3:
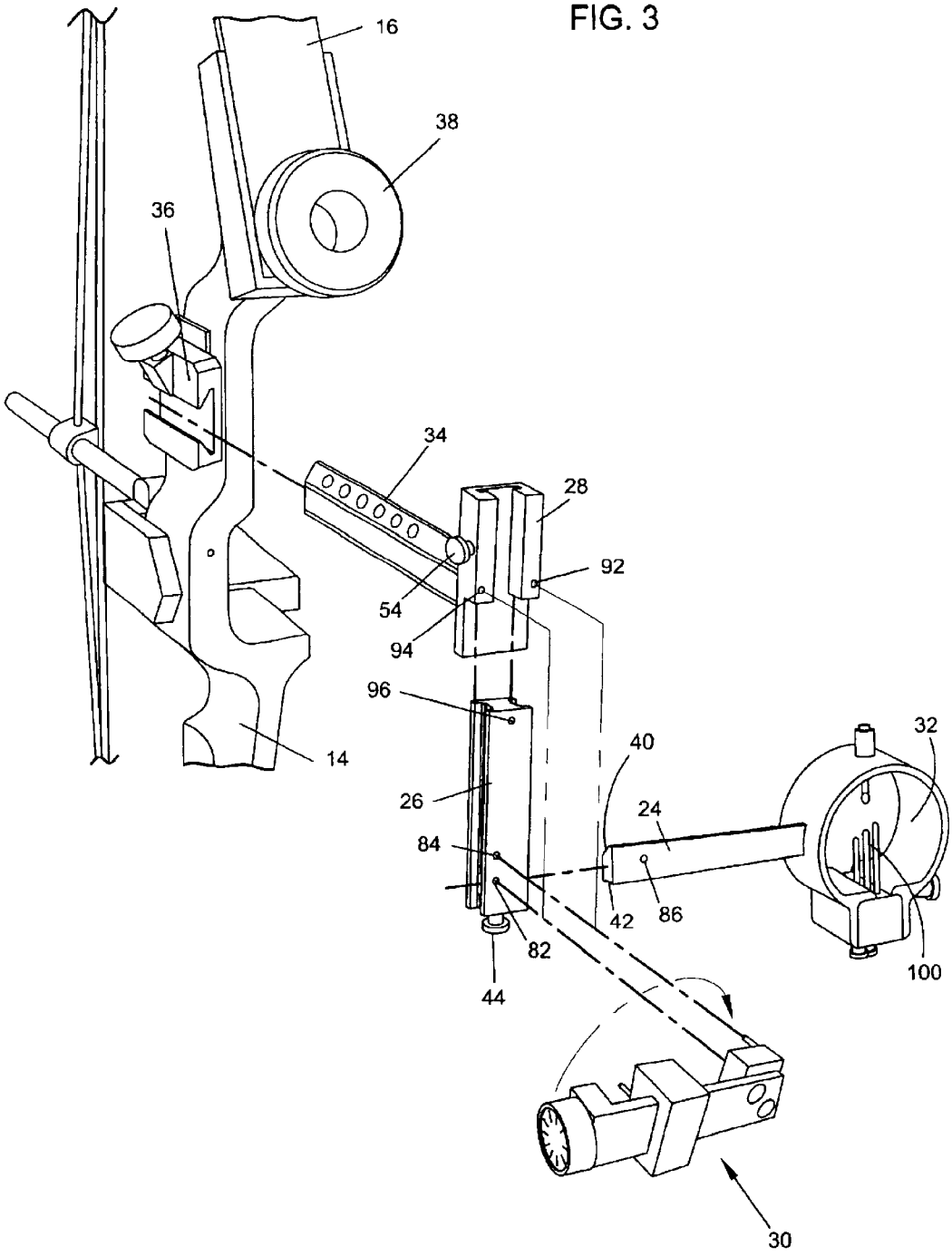
FIG. 3 is an exploded front perspective view of one embodiment of the adjustment member and bow sight of the present invention and a portion of the bow of the type shown in FIG. 1.
Figure 4:
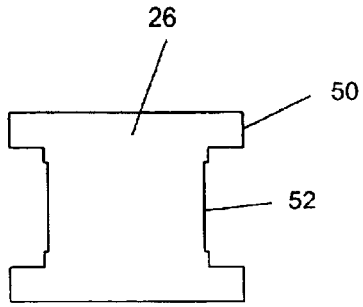
FIG. 4 is a top plan view of the vertical slide of the type shown in FIG. 3.

Referring now to FIGS. 2 and 3, the bow sight 10 will now be described in greater detail. Although other shapes and slide arrangements may be constructed in accordance with the present invention, the preferred embodiment of the vertical slide 26 is constructed of an I-beam that slidably engages within a slot formed in the vertical slide mount 28. An aperture of approximately the same shape as the end of the horizontal bar 24 extends through a side of the vertical slide 26. The horizontal bar 24 is supported by and slides within this aperture. The horizontal bar 24 includes a beveled edge 40 that assists with proper alignment of the bar and further includes a groove 42 formed in one side of the horizontal bar 24. Setscrew 44 may be tightened against the groove 42 to hold the horizontal bar 24 rigid within the aperture of the vertical slide 26. In a like manner setscrew 54 may be tightened against channel 52 (see FIG. 4) to hold the channels 50 firmly and rigidly within the slot of the vertical slide mount 28.

Figure 5:
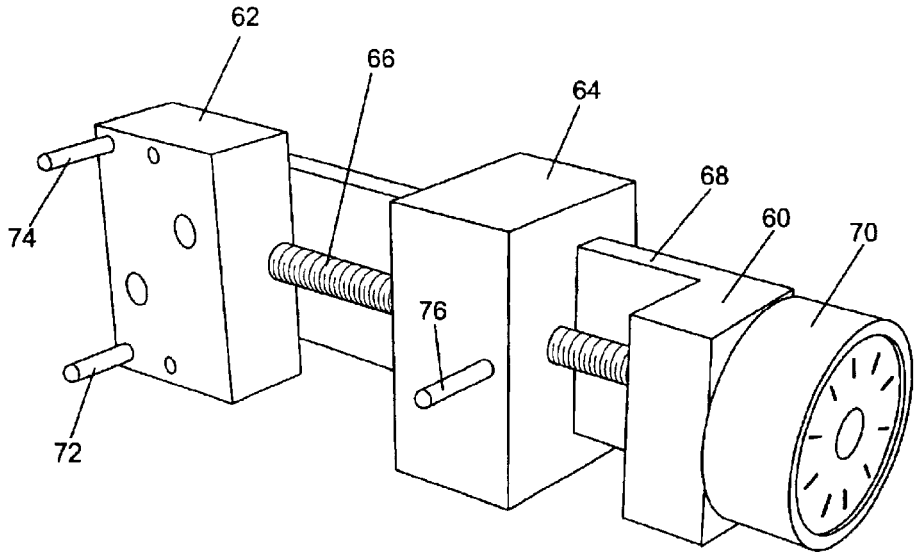
FIG. 5 is a bottom perspective view of the adjustment member of the present invention and of the type shown in FIG. 3.

Referring now to FIG. 5, the removable, micro adjustment member 30 includes a first fixed end 60, second fixed end 62, slide 68 extending between the first and second fixed ends 60 and 62, a sliding member 64 and rotation knob 70. The sliding member 64 slides over the slide 68. Screw 66 is fixedly attached to the knob 70 and extends through clearance holes formed in the first and second fixed ends 60 and 62. A stop is attached to the end of the screw 66 to keep the screw 66 from pulling out of the clearance holes. The screw also extends through a threaded hole formed in the sliding member 64. When the knob 70 is turned counterclockwise the sliding member 64 slides along the slide 68 in a first direction. When the knob 70 is turned clockwise the sliding member 64 slides along the slide 68 in a second direction opposite the first direction. The adjustment member 30 also includes pins 72 and 74 extending from the bottom of the second fixed end and pin 76 extending from the bottom of the sliding member 64.

Figure 6:
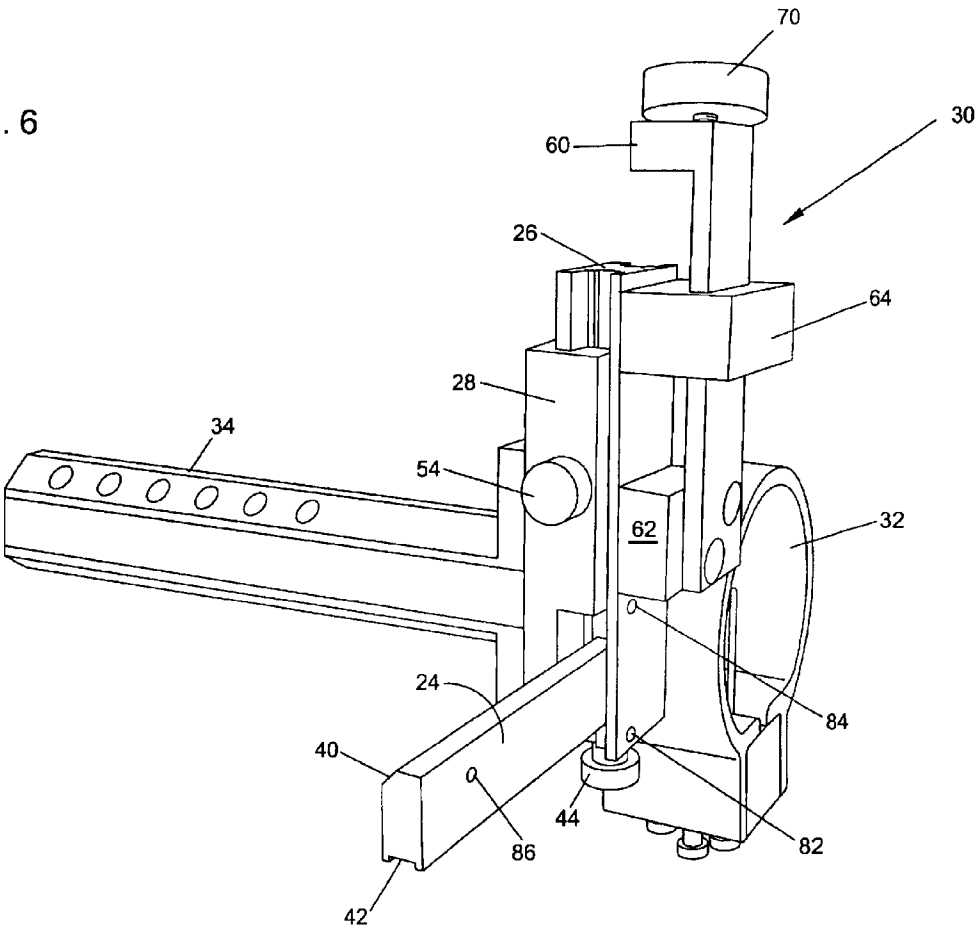
FIG. 6 is a front perspective view of the bow sight of the present invention with the adjustment member engaged to move the bow sight in controlled, finite adjustments in the vertical direction.

Having described the constructional features of the present invention use of the adjustment member 30 to adjust the scope in finite controlled increments in both the vertical and horizontal direction will next be presented. With reference to FIG. 6, adjustment of the bow sight in the vertical direction will be described. First, the user aligns pins 72 and 74 of the adjustment member 30 with apertures 94 and 92 (see FIG. 3) formed in the vertical slide mount 28. The user then turns the knob 70 of the adjustment member 30 in the appropriate direction until the pin 76 aligns with aperture 96 formed in the vertical slide 26 (see FIG. 3). Once the three pins are aligned, the user presses against the adjustment member to thereby affectively press the pins into the apertures. Once the adjustment member 30 is engaged to the vertical slide 26 and slide mount 28, the setscrew 54 is loosened. The knob 70 may then be turned in either direction by finite increments to thereby adjust vertically the aiming sight 32 in corresponding sequential finite increments. When the sight 32 has been moved the desired amount, the set screw 54 is tightened and the pins 72, 74, and 76 pulled from the apertures of the slide 26 and slide mount 28. If the user desires to again adjust the vertical position of the sight 32, the adjustment member 30 is again engaged to the slide 26 and slide mount 28 and the sight 32 may be adjusted by the next sequential finite increment. Those skilled in the art will appreciate that the scope 32 may include pins that may be further adjusted in the vertical direction.

Figure 7:
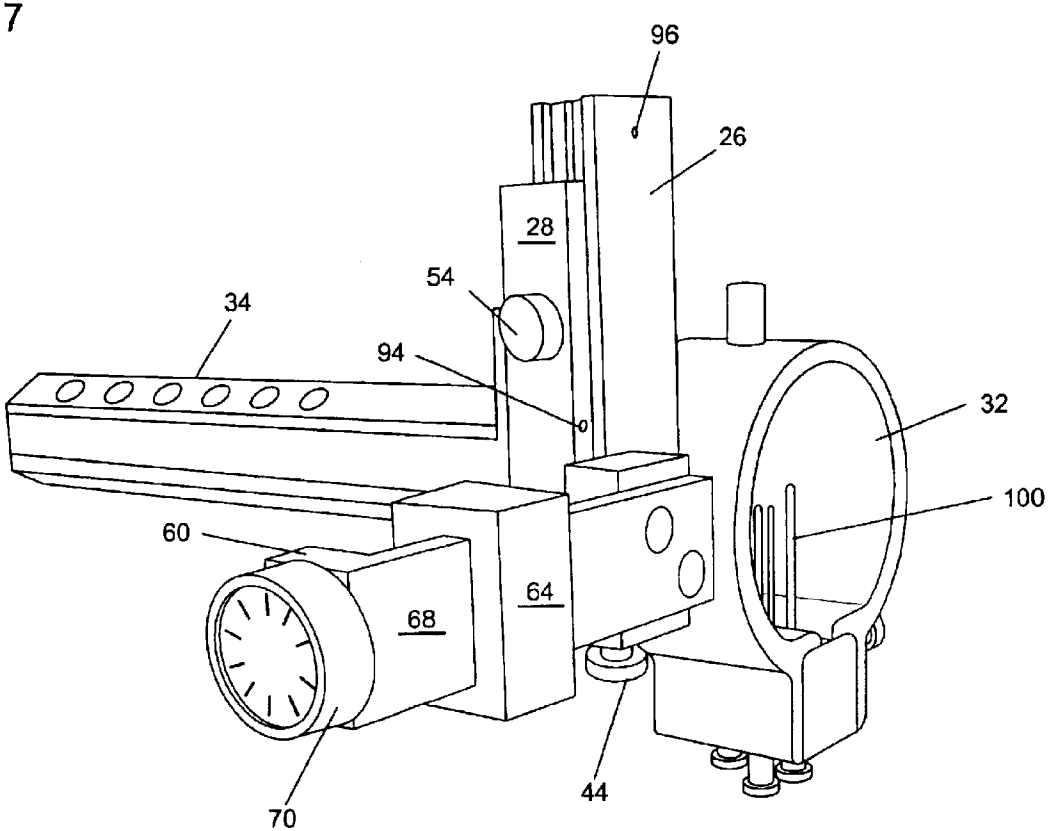
FIG. 7 is a front perspective view of the bow sight of the present invention with the adjustment member engaged to move the bow sight in controlled, finite adjustments in the horizontal direction.

With reference to FIG. 7, adjustment of the bow sight in the horizontal direction will be described. First, the user aligns pins 72 and 74 of the adjustment member 30 with apertures 82 and 84 (see FIG. 3) formed in the vertical slide 26. The user then turns the knob 70 of the adjustment member 30 in the appropriate direction until the pin 76 aligns with aperture 86 formed in the horizontal bar 24 (see FIG. 3). Once the three pins are aligned, the user presses against the adjustment member to thereby affectively press the pins into the apertures. Once the adjustment member 30 is engaged to the vertical slide 26 and horizontal bar 24, the setscrew 44 is loosened. The knob 70 may then be turned in either direction by finite increments to thereby adjust horizontally the aiming sight 32 in corresponding sequential finite increments. When the sight 32 has been moved the desired amount, the set screw 44 is tightened and the pins 72, 74, and 76 pulled from the apertures of the slide 26 and horizontal bar 24. If the user desires to again adjust the horizontal position of the sight 32, the adjustment member 30 is again engaged to the slide 26 and horizontal bar 24 and the sight 32 may be adjusted by the next sequential finite increment.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself.

What is claimed is:

1. A device for assisting an archer in shooting an arrow from a bow while aiming the arrow at a target, the device comprising:

a vertical slide;

a vertical slide mount slidably engaged with the vertical slide to allow movement of the vertical slide in a vertical direction;

a horizontal bar adapted for receiving an aiming sight and engaged with at least one of the vertical slide and vertical slide mount to allow movement of the horizontal bar in a horizontal direction; and a removable adjustment member adapted to contact the vertical slide to adjust the aiming sight in controlled, finite, repeatable, increments in the vertical direction relative to a fixed point on the bow and relocatable to be adapted to contact the horizontal bar to adjust the aiming sight in controlled, finite, repeatable, increments in the horizontal direction relative to a fixed point on the bow.

2. The device of claim 1, further including a mounting member mounted to the bow and engaged to the vertical slide mount.

3. The device of claim 2, further including an extension member extending between the mounting member and the vertical slide mount.

4. The device of claim 1 further including a first coupling to couple the adjustment member to the horizontal bar and at least one of the vertical slide and vertical slide mount.

5. The device of claim 1 further including a second coupling to couple the adjustment member to the vertical slide and vertical slide mount.

6. A device for assisting an archer in shooting an arrow from a bow while aiming the arrow at a target, the device comprising:

a bar adapted for receiving an aiming sight;

a slide slidably engaged with the bar to allow movement of the bar in an approximately horizontal direction;

a slide mount slidably engaged with the slide to allow movement of the slide in an approximately vertical direction; and a removable adjustment member adapted to contact the slide to adjust the aiming sight in controlled, finite, repeatable, increments in the approximately vertical direction relative to a fixed point on the bow and relocatable to be adapted to contact the bar to adjust the aiming sight in controlled, finite, repeatable, increments in the approximately horizontal direction relative to a fixed point on the bow.

7. The device of claim 6, further including a mounting member mounted to the bow and engaged to the slide mount.

8. The device of claim 7, further including an extension member extending between the mounting member and the slide mount.

9. The device of claim 6 further including a second coupling to couple the adjustment member to the slide and slide mount.

10. An aiming device for assisting an archer while aiming an arrow at a target, the device comprising:

a sight assembly attached to a bow;

horizontal means for adjusting the sight assembly in a substantially horizontal plane;

vertical means for adjusting the sight assembly in a substantially vertical plane; and a removable adjustment member adapted to contact the vertical means to adjust the aiming sight in controlled, finite, repeatable, increments in the vertical direction relative to a fixed point on the bow and relocatable to be adapted to contact the horizontal means to adjust the aiming sight in controlled, finite, repeatable, increments in the horizontal direction relative to a fixed point on the bow.

11. The device of claim 10 further including a first coupling that couples the adjustment member to the horizontal means.

12. The device of claim 10 further including a second coupling that couples the adjustment member to the vertical means.

* * * * *